United States Patent [19]

Clarke

[11] 4,014,325

[45] Mar. 29, 1977

[54] UNIQUE MECHANICAL FOOT MASSAGER

[76] Inventor: Charles W. Clarke, 207 N. Main, Morton, Ill. 61550

[22] Filed: Dec. 22, 1975

[21] Appl. No.: 643,017

[52] U.S. Cl. ..... 128/57; 128/25 B

[51] Int. Cl.[2] ..... A61H 15/00

[58] Field of Search ..... 128/57, 24.3, 67, 68, 128/69, 25 B

[56] References Cited

UNITED STATES PATENTS

| | | | |
|---|---|---|---|
| 2,219,086 | 10/1940 | Broberg | 128/57 |
| 3,888,241 | 6/1975 | Fischer | 128/57 |

FOREIGN PATENTS OR APPLICATIONS

| | | | |
|---|---|---|---|
| 1,039,932 | 5/1953 | France | 128/57 |
| 1,016,702 | 9/1952 | France | 128/57 |
| 295,706 | 7/1929 | United Kingdom | 128/57 |

*Primary Examiner*—Lawrence W. Trapp
*Attorney, Agent, or Firm*—Hosier, Niro & Daleiden, Ltd.

[57] ABSTRACT

A massaging device including a cylindrical member having a configured lateral surface which is used to massage and manipulate the foot or other extremities of the body.

2 Claims, 2 Drawing Figures

UNIQUE MECHANICAL FOOT MASSAGER

BACKGROUND AND SUMMARY OF THE INVENTION

The present invention relates to a massage device and, more particularly, to a massage roller for use with the sole of the foot or with other extremities to alleviate bodily discomfort.

Ailments of the feet are well known and vary widely in cause. Poor circulation, poor muscle tone, atrophied muscle structures, weakened ligaments, and many other foot problems will respond to massage and manipulation, thereby alleviating the bodily discomfort associated therewith.

The present invention is directed to a device which enables a person to easily manipulate and massage the foot or other extremities. The novel massage device includes a specially designed external surface which enhances and assures proper massage and manipulation.

BRIEF DESCRIPTION OF THE DRAWINGS

The novel features which are believed to be characteristic of the invention are set forth in the appended claims. The invention itself, however, together with further objects and attendant advantages thereof, will be best understood by reference to the following description taken in connection with the accompanying drawings, in which:

DETAILED DESCRIPTION OF THE INVENTION

Figure 1:
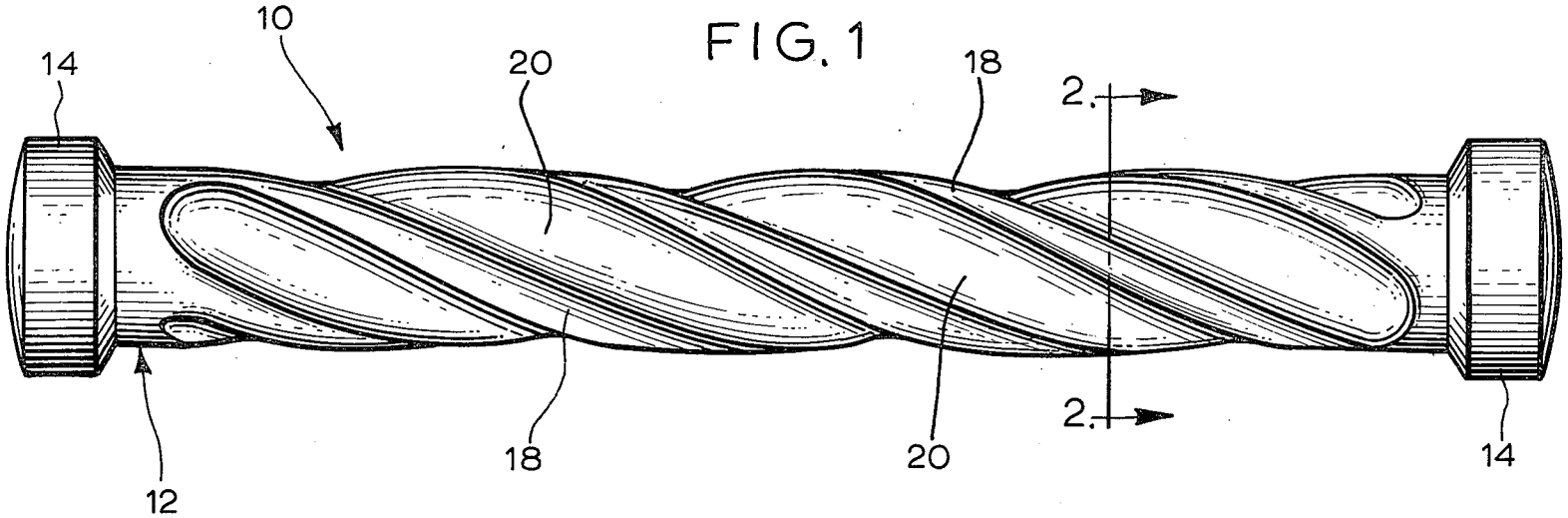
FIG. 1 is a side elevational view showing various features of the massage roller of the present invention.

Referring to the drawings, the massaging device of the present invention, designated generally as 10, includes a generally cylindrical member 12 having at each extremity thereof a flange 14. The flanges 14 allow the device to be rolled across a supporting surface, as described below, to provide the desired massage and manipulation of the body portion being treated.

The cylindrical member 12 has a lateral surface 16 which includes a plurality of spirally disposed ridges 18 and recesses 20. The ridges are equally spaced about the circumference of member 12 and extend substantially its entire length.

In accordance with a principal feature of the invention the member 12, including ridges 18 and recesses 20, is designed and configured to provide proper massage and manipulation of the body portion being treated. Thus, it has been determined that the degree of angular displacement and the spacing of the ridges 18 are important to the function of the device. For example, it is preferred that the ridges 18 be displaced between about 20° to 40° from the longitudinal axis of the member 12 and that the center line of each ridge be spaced from about 0.5 to 1.60 inches from adjacent ridges. Using these dimensional parameters in conjunction with a member 12 having a diameter between about 0.75 and 2.00 inches has proven to provide proper massage and manipulation of a desired character and intensity. Optimum results are obtained with a 1.25 inch diameter roller having ridges displaced from the longitudinal axis by about 30° and spaced about 0.9 inches about the rollers circumference.

The term "proper massage and manipulation" as used herein is intended to mean that the skeletal structure of the extremity being treated will be subjected to flexion, extension, abduction and adduction during use. This, in turn, assures the optimum therapeutic effect.

Figure 2:
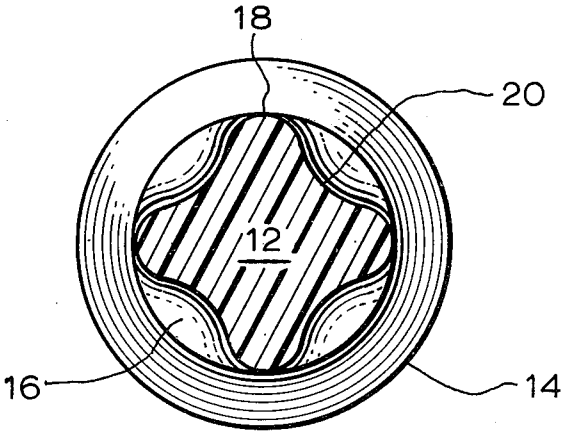
FIG. 2 is a cross-sectional view taken along line 2—2 of FIG. 1.

As can be most clearly seen in FIG. 2, the surface 16 of member 12 is a continuous curve having no sharp corners or flattened surfaces. The portions of surface 16 intermediate narrow ridges 18 are formed into wide concave recesses 20. In this manner the roller 10 will provide the proper massage and manipulation action without danger of cutting or bruising the body portion under treatment.

In operation of the device, the hand or foot is placed on the member 12 and pressure as desired is applied while simultaneously moving the roller transversely. For example, the sole of the foot is placed on the member 12 and moved forward and backward. As the various joints of the foot move over a ridge 18, flexion occurs. As the joint moves over a recess portion 20, extension occurs. At the same time, the angular displacement of the spirally disposed ridges causes the various joints and skeletal components to torque, effecting abduction and adduction.

The massaging device of the present invention may be constructed from any one of a number of well known materials, including wood, metal, plastics and ceramics. It is preferred, however, that the roller be sufficiently rigid such that the ridges 18 and member 12 will not deform upon the application of pressure during normal use.

Of course, it should be understood that various changes and modifications to the preferred embodiments described herein will be apparent to those skilled in the art. Such changes and modifications can be made without departing from the spirit and scope of the present invention and without diminishing its attendant advantages. It is, therefore, intended that such changes and modifications be covered by the following claims.

I claim:

1. The massaging device of claim 5 wherein said cylindrical member has a diameter between about 0.75 and 2.00 inches and said spiral ridges are spaced between about 0.5 and 1.60 inches on the circumference of said member.

2. A massaging device comprising a rigid cylindrical member having a lateral surface including a plurality of spirally disposed narrow ridges and wide concave recesses intermediate said ridges, said ridges and said recesses being disposed at an angle between about 20° and 40° from the longitudinal axis of said member, thereby providing proper massage and manipulation to the body portion being treated by said device.

* * * * *

UNITED STATES PATENT AND TRADEMARK OFFICE

CERTIFICATE OF CORRECTION

PATENT NO. : 4,014,325

DATED : March 29, 1977

INVENTOR(S) : Charles W. Clarke

It is certified that error appears in the above-identified patent and that said Letters Patent are hereby corrected as shown below:

Column 2, line 49, "1" should be --2-- and "5" should read --1--.

Column 2, line 54, "2" should be --1--.

Signed and Sealed this

*Sixth* Day of *September 1977*

[SEAL]

*Attest:*

RUTH C. MASON
*Attesting Officer*

LUTRELLE F. PARKER
*Acting Commissioner of Patents and Trademarks*